United States Patent [19]

Stritzke

[11] 3,960,347

[45] June 1, 1976

[54] ATTACHMENT FOR KITES AND THE LIKE

[76] Inventor: Gerd O. Stritzke, 15 W. 473 Jefferson St., Bensenville, Ill. 60106

[22] Filed: Apr. 3, 1975

[21] Appl. No.: 564,844

Related U.S. Application Data

[63] Continuation of Ser. No. 423,276, Dec. 10, 1973, abandoned.

[52] U.S. Cl. ..... 244/155 R

[51] Int. Cl.[2] ..... B64C 31/06

[58] Field of Search ..... 244/155 R, 153–154

[56] References Cited

UNITED STATES PATENTS

| | | | |
|---|---|---|---|
| 563,066 | 6/1896 | Rogers | 244/155 R |
| 1,655,794 | 1/1928 | Moore | 244/155 R |
| 2,750,136 | 6/1956 | Stracke | 244/155 R |
| 2,785,871 | 3/1957 | Flint et al. | 244/155 R |
| 3,006,586 | 10/1961 | Strelakos | 244/155 R |
| 3,687,403 | 8/1972 | Guinn | 244/155 R |

*Primary Examiner*—Trygve M. Blix
*Assistant Examiner*—Galen L. Barefoot
*Attorney, Agent, or Firm*—Henry L. Brinks

[57] ABSTRACT

A device for attachment to kite strings which is provided with pair of semi-circular wings. The wings are secured in an outstretched position during ascent of the device, and are folded during descent of the device. A spring system holds the wings in folded position during descent.

2 Claims, 8 Drawing Figures

FIG. 1
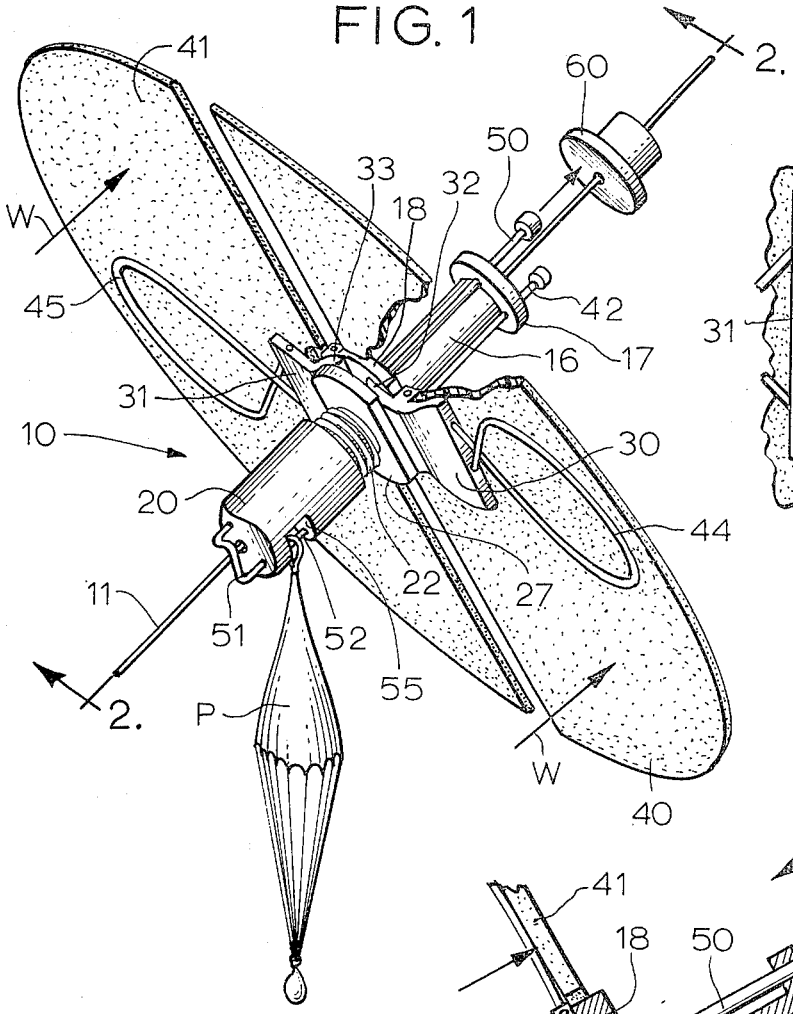
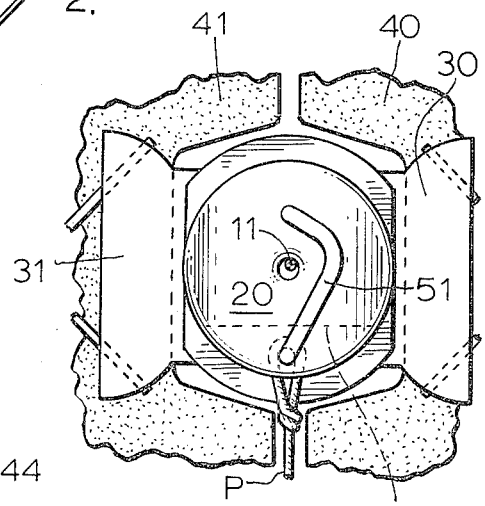
FIG. 3
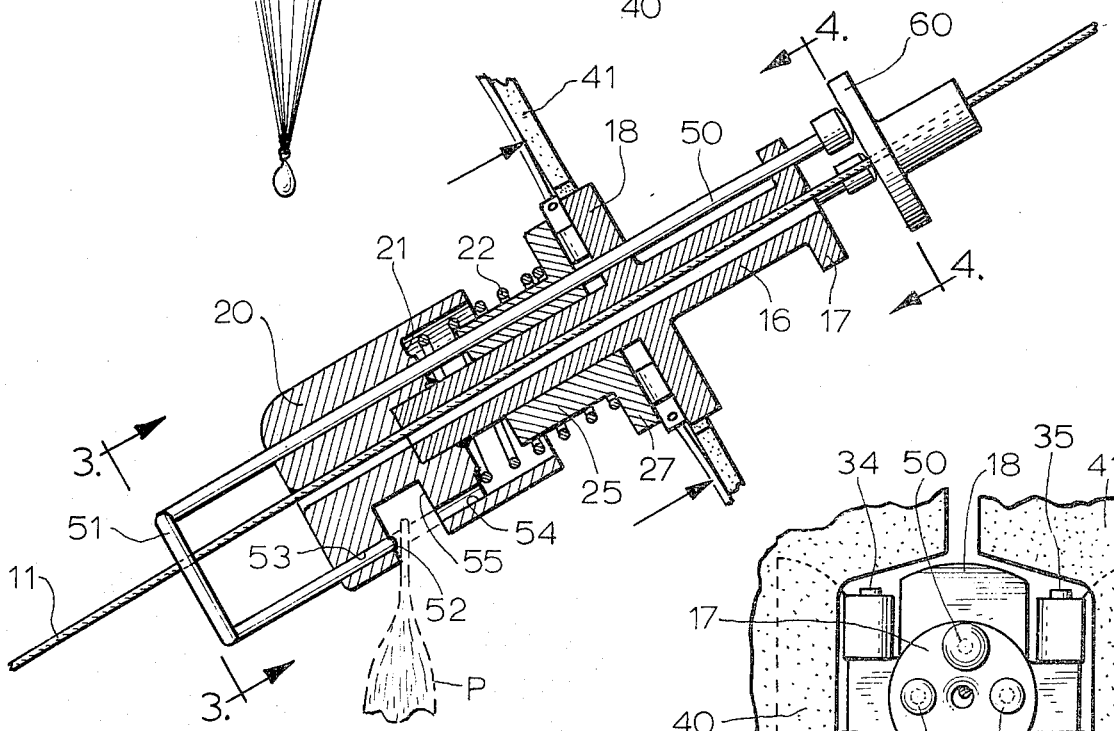
FIG. 2
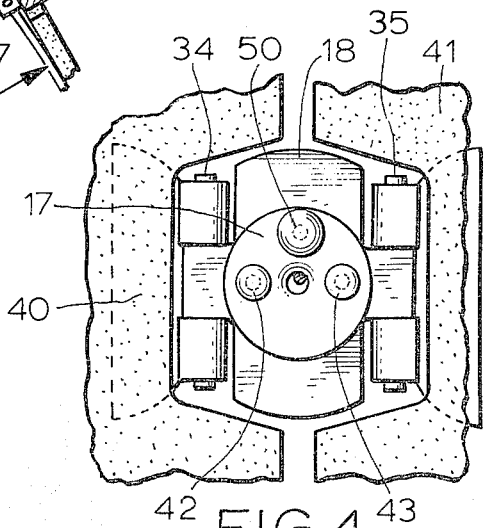
FIG. 4

ATTACHMENT FOR KITES AND THE LIKE

This is a continuation of application Ser. No. 423,276, filed Dec. 10, 1973, now abandoned.

This invention relates as indicated to an attachment for kites and the like, and more particularly to an accessory device for ascending a line to a predetermined point after which it is returned.

DEVELOPMENT OF THE INVENTION

Kite accessories of various types are known for ascending a kite string responsive to wind pressures. Such accessories are characterized by hangers for suspending the device from a string, and by wings which are outstretched during ascension and which are folded during descension.

The wings, however, tend to rotate such accessory about the string, not unlike the rotation of a propeller, and unless it is weighted with cargo during the ascension so as to prevent rotation, it can become fouled with the string. Moreover, if hangers are used for suspending the accessory on the string, the hangers can cause fouling with the string during any rotation of the device.

In many prior accessories, the wings are collapsed for descension, but are freely swingable to outstretched position. This results in a tendency for wings to rotate the accessory after release of the cargo, and for a gust of air to tend to spin the accessory on the string. Again, in such event, the rotation can cause fouling between the accessory and the string.

SUMMARY OF THE OBJECTIVES OF THE INVENTION

Accordingly, it is an objective of the invention to provide an accessory device for use with a line to a kite, balloon, or the like, which reduces the tendency to rotate about the line during ascension and/or descension.

Another object of the invention is to provide an accessory device in which the wings are locked in a folded position during descension.

The above and other objects of the invention are accomplished in a manner which is apparant from the following specification, claims, and appended drawings.

BRIEF DESCRIPTION OF THE DRAWINGS

FIG. 1 is a perspective view of an accessory device for kites, ballons, and the like, illustrating the preferred embodiment of my invention, and showing the device carrying a parachute as cargo.

FIG. 2 is a sectional view taken substantially along line 2—2 of FIG. 1.

FIG. 3 is a view taken substantially along line 3—3 of FIG. 2.

FIG. 4 is a new taken substantially along line 4—4 of FIG. 2.

DESCRIPTION OF THE PREFERRED EMBODIMENT

Figure 5:
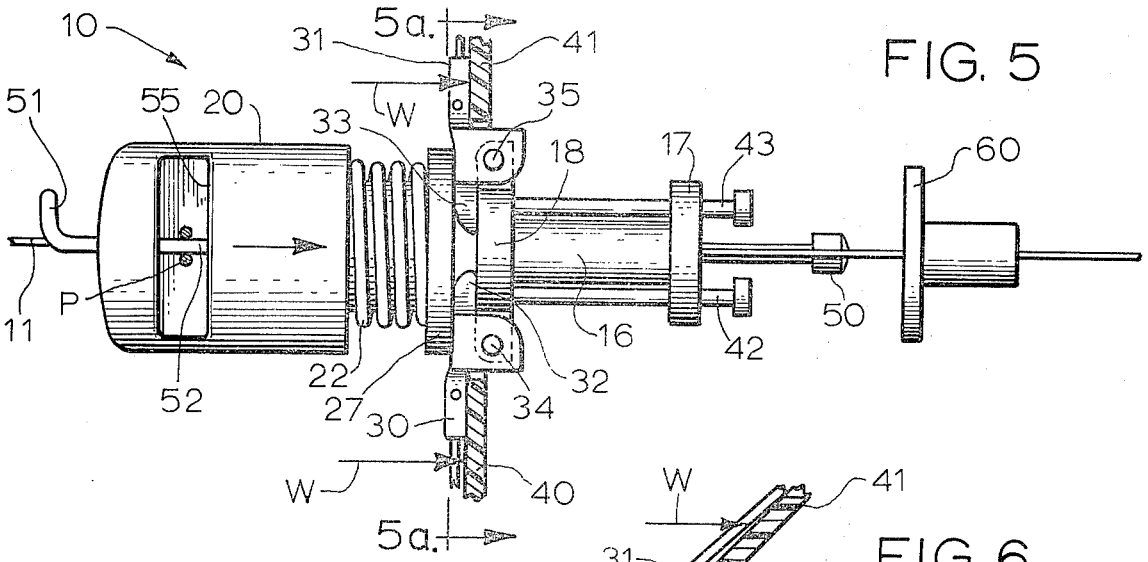
FIG. 5 is an enlarged bottom view of the device shown in FIG. 1 with the wings broken away.

Referring now to FIGS. 1 and 2 of the drawing, an accessory device indicated generally by reference numeral 10 is mounted for sliding movements on a line or string 11 as may be employed to a kite, balloon, or the like.

A shaft 15 is provided with a longitudinal opening 16 for the line 11. A flange 17 is formed at the forward end of the shaft, and support member 18 is formed on the shaft at a point spaced rewardly from flange 17.

A body member 20 fixedly secured to the rear position of shaft 15 has a spring retaining member in the form of a concave opening 21 for receiving spring element 22. Sleeve 25 slidably mounted on shaft 16 is biased by spring 22 toward support element 18. Spring 22 engages flange 27 formed on the forward end of the sleeve 25 and spring retainer 21 to urge the sleeve toward support member 18.

A pair of pivotable supports 30, 31 are mounted on opposite sides support member 18. As best shown in FIG. 5, each wing support has an ear 32, 33, respectively, that is contained between the flange 27 and the support member 18 when the wings are outstretched during ascent of the device. Wing supports 30, 31 are pivotable on pins 34 and 35, respectively.

As shown in FIG. 1, semi-circular wings 40 and 41 are secured to the pivotable wing supports 30 and 31. It will be noted that the semi-circular wings in outstretched position as illustrated in FIG. 1 together form a substantially circular wing area. The wing surface area, of course, should be of sufficient area to provide enough force to drive the device 10 up the string.

Figure 6:
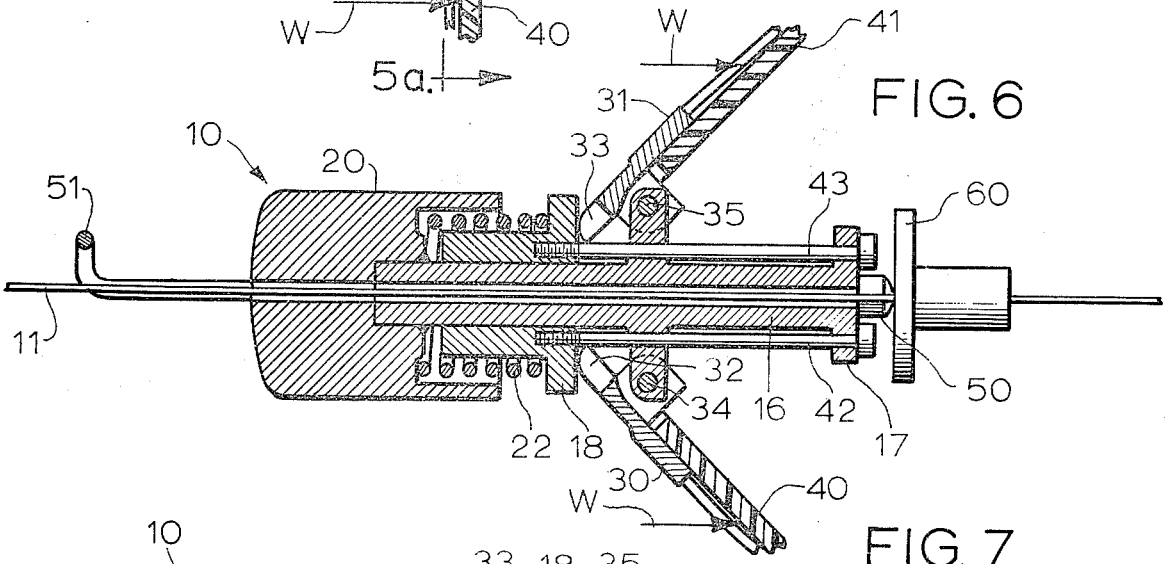
FIG. 6 is a sectional view of the device in FIG. 5 with the wings beginning movement to folded position.
Figure 7:
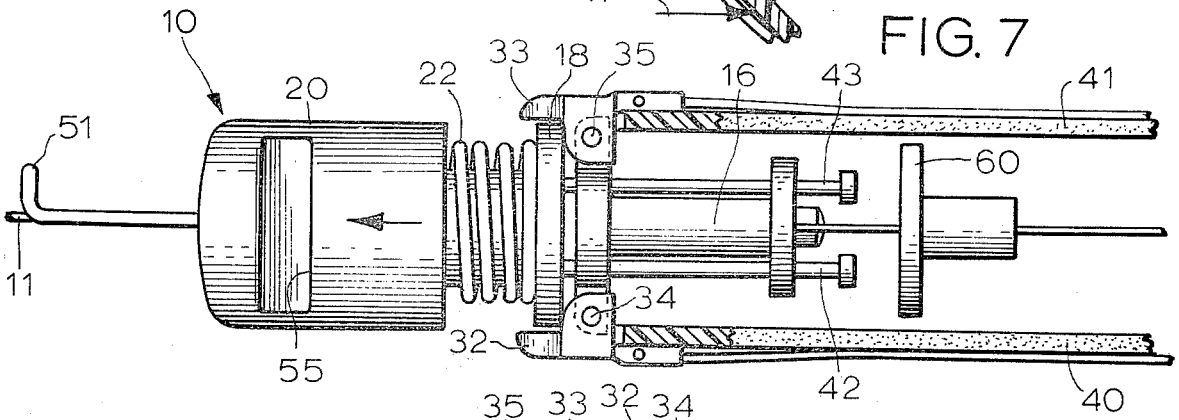
FIG. 7 is a bottom view similar to FIG. 5 except with the wings in folded position and illustrating the position of the release mechanism after the device has engaged a stop.
Figure 5A:
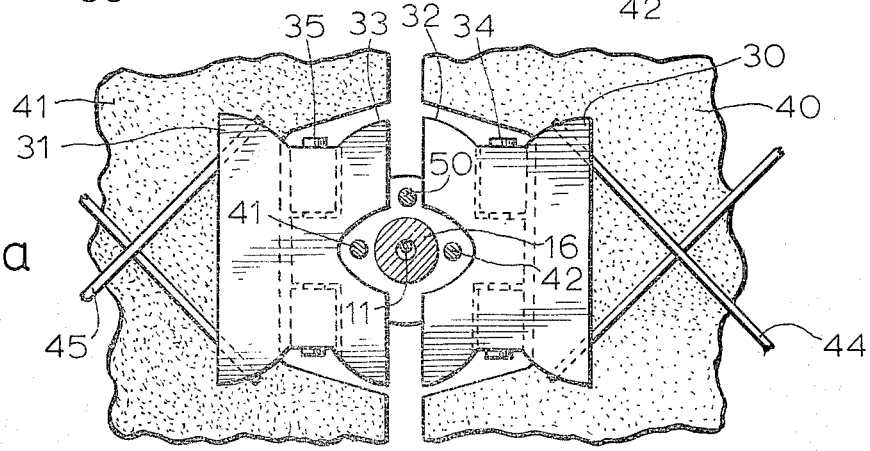
FIG. 5*a* is a view taken substantially along line 5*a* —5*a* of FIG. 5.

As shown in FIGS. 5 to 7, a pair of rods secured to the sleeve 25 extend toward the forward end of the device through openings in support member 18 and flange 17. Depression of the rods toward flange 17 compresses the spring 22 between flange 17 on sleeve 25 and the spring retainer 21.

A cargo release system also is provided. Referring to FIGS. 1, 2 and 3, a rod 50 extends from a point in advance of flange 17 to a point rearwardly of body member 20. The rod is formed with bent portion 51 for encircling the line 11 and a return bent end 52 that is received in openings 53 and 54 on the lower portion of the body 20. A slot 55 is formed in the body 20 between openings 53 and 54 for receiving an attaching ring of the cargo.

As shown by way of example in FIG. 1, a parachute P has an attaching ring that is held by the return bent end 52 of rod 50 in the slot 55 of the body member 20. When the forward end of rod 50 engages a stop, such as stop 60, suitably secured to line 11, the rod is moved rearwardly and the return bent end is withdrawn from the slot 55 as illustrated in FIG. 2, so that the cargo is released.

From the foregoing description, it is believed that operation of the device should be apparent. Manual depression of rods 42, 43 compresses spring 22 and allows the wings to be fully extended to the position illustrated in FIG. 1. With the wings fully extended, the rods are released so that the ears 32 and 33 are clamped between support 18 and flange 27. Clamping of the ears between members 18 and 27 holds the wings in a position transverse to the axis of string 11. Wind movement against the wings, as indicated by the arrows W in FIG. 1, drives the device 10 up the string 11 toward the stop 60. When the rod 50 engages the stop 60, the return bent end 52 is withdrawn from the slot 55, and the cargo released.

As indicated in FIGS. 6 and 7, when the device 10 is driven against the stop 60 by wind depicted by arrows W, the wings 40, 41 are folded until the ears 32, 33 are pivoted outside the flange 27. The spring 22 then biases sleeve 25 so that the flange 27 is held between the ears 32 and 33, whereby the wings are locked in folded position substantially parallel to the axis of string 11, as depicted in FIG. 7. When the wings are folded as shown in FIG. 7, the device 10 returns by gravity along the string.

The advantages of the invention should be clear. The semi-circular wings, which when in extended position form a substantially circular surface, reduce the tendency for the device to rotate upon ascension. Moreover, the mechanism, including spring 22 which locks the wings in folded position for descent, reducing the tendency to rotate during descension.

In the drawing and specification, there has been set forth preferred embodiments of the invention, and although specific terms are employed, these are used in a generic and descriptive sense only, and not for purpose of limitation. Changes in form and proportion of parts, as well as substitution of equivalents are contemplated, as circumstances may suggest or render expedient, without departing from the spirit or scope of this invention, as further defined in the following claims.

I claim:

1. A device for climbing a kite string and for subsequently descending the string, comprising in combination:

a longitudinally extending member having a longitudinal opening therethrough adapted to receive a kite string;

a pair of wings hingedly secured on said member;

said wings adapted to be releasably secured in a position substantially transverse to the axis of the string and to be folded to a position substantially parallel to the axis of the string;

means for releasably locking said wings in said transverse position during ascent of the device on the kite string;

means for inhibiting the rotation of said device about the kite string during ascent, said means comprising each of said wings being formed in a semi-circular shape whereby together in the transverse position they form a substantially aerodynamically stable circular wing area;

means for releasing said wings from said transverse position upon the engagement of a stop on the kite string; and means including a spring member mounted substantially coaxial to said longitudinal opening for holding said wings in said transverse position during the ascent and in said parallel folded position during the descent of the device on the kite string.

2. The device of claim 1 which further includes means for releasably holding cargo for dropping when the device engages a stop on the kite string.

* * * * *

UNITED STATES PATENT AND TRADEMARK OFFICE

CERTIFICATE OF CORRECTION

PATENT NO. : 3,960,347

DATED : June 1, 1976

INVENTOR(S) : GERD O. STRITZKE

It is certified that error appears in the above-identified patent and that said Letters Patent are hereby corrected as shown below:

IN THE SPECIFICATION:

Column 1, line 27, add the after "for."

Column 1, line 57, "new" should be -- view --.

Column 2, line 12, "rewardly" should be -- rearwardly --.

Signed and Sealed this

First Day of July 1980

[SEAL]

Attest:

SIDNEY A. DIAMOND

Attesting Officer

Commissioner of Patents and Trademarks